US006130195A

United States Patent [19]

Doyel et al.

[11] Patent Number: 6,130,195

[45] **Date of Patent: *Oct. 10, 2000**

[54] CLEANING COMPOSITIONS AND METHODS FOR CLEANING USING CYCLIC ETHERS AND ALKOXY METHYL BUTANOLS

[75] Inventors: Kyle J. Doyel, Franklin; Michael L. Bixenman, Old Hickory; Scotty S. Sengsavang, Murfreesboro; Kristie L. Gholson, Murfreesboro; Patricia D. Overstreet, Murfreesboro; Arthur J. Thompson, Madison; Valerie G. Porter, Antioch, all of Tenn.

[73] Assignee: Kyzen Corporation, Nashville, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,065

[22] Filed: Nov. 3, 1997

[51] Int. Cl.[7] ..... C11D 7/50; C11D 7/24

[52] U.S. Cl. ..... 510/365; 510/245; 510/254; 510/407; 510/505; 510/175; 510/174

[58] Field of Search ..... 510/175, 176, 510/174, 245, 254, 365, 407, 499, 505, 506

[56] References Cited

U.S. PATENT DOCUMENTS

| | | | |
|---|---|---|---|
| 4,617,251 | 10/1986 | Sizensky | 430/256 |
| 5,128,057 | 7/1992 | Bixenman et al. | 252/162 |
| 5,308,402 | 5/1994 | Bixenman et al. | 134/2 |
| 5,472,830 | 12/1995 | Honda | 430/331 |
| 5,744,437 | 4/1998 | Rowe et al. | 510/204 |

FOREIGN PATENT DOCUMENTS

| | | |
|---|---|---|
| 426512B | 8/1991 | European Pat. Off. . |
| 629671 A2 | 12/1994 | European Pat. Off. . |
| 9-191007 | 7/1997 | Japan . |

OTHER PUBLICATIONS

Chemical Abstracts Registry No. 97–99–4, "Tetrahydrofurfuryl alcohol", 1998.

Chemical Abstracts Registry No. 33606–34–7, "2–Furanethanol, tetrahydro–", 1998.

Chemical Abstracts Registry No. 767–08–8, "2–Furanpropanol, tetrahydro", 1998.

*Primary Examiner*—William Krynski
*Assistant Examiner*—Dawn L. Garrett
*Attorney, Agent, or Firm*—Evenson, McKeown, Edwards & Lenahan, P.L.L.C.

[57] ABSTRACT

Compositions and methods for cleaning, degreasing, stripping, solvating and/or removing residues and contaminants such as oils, grease, dirt, flux, inks, coatings, photoresists, resins and polymers from manufactured articles and hard surfaces such as, but not limited to metals, plastics, textiles, electronic devices, silicon wafers, mechanical devices or manufacturing equipment. The compositions contain at least one 4 carbon cyclic ether solvent mixtures with at least one 3-alkoxy 3-methyl butanol, as well as other optional alkaline materials as well as other optional solvents and additives. The compositions can be contacted with a surface to be cleaned in a number of ways and under a number of conditions depending on the manufacturing or processing variables present.

22 Claims, No Drawings

CLEANING COMPOSITIONS AND METHODS FOR CLEANING USING CYCLIC ETHERS AND ALKOXY METHYL BUTANOLS

BACKGROUND AND SUMMARY OF THE INVENTION

This invention relates to compositions useful in and methods for cleaning, degreasing, stripping, solvating and/or removing residues and contaminants from manufactured articles and hard surfaces.

More particularly, this invention relates to compositions useful in and methods for cleaning, degreasing, stripping, solvating and/or removing residues such as oils, grease, dirt, flux, inks, coatings, photoresists, resins and polymers and contaminants from manufactured articles and hard surfaces such as, but not limited to metals, plastics, textiles, electronic devices, silicon wafers, mechanical devices or manufacturing equipment.

According to this invention, 4-carbon cyclic ether solvent mixtures with 3-alkoxy-3-methyl butanol, and optionally with alkaline materials or with other materials known to those skilled in the art can be used to replace highly ozone depleting materials such as chlorofluorocarbons (CFC), methyl chloroform, hydrochlororfluorocarbons (HCFC), or chlorinated solvents. There is an unexpected and broad level of solubility obtained for many varied cleaning applications by the use of the solvent mixtures which is not obtained by using a single component solvent system.

Four-carbon cyclic ether solvents of the disclosed invention correspond to the following formula:

(Formula I)

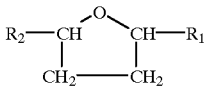

Where $R_1$ and $R_2$ can be independently hydrogen, or 1 to 8 carbon length alkyl, alkoxy or ether groups.

The disclosed 3 alkoxy 3 methyl butanol corresponds to the following formula:

(Formula II)

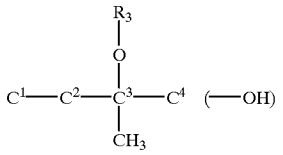

Where the OH group of the butanol can be attached to carbon position 1, 2 or 4, and $R_3$ is hydrogen or 1 to 8 carbon length alkyl.

The optional alkaline material is any material known to those skilled in the art that would cause the pH of the solution to be greater than 6. Materials such as alkaline hydroxides, carbonates, bicarbonates, and silicates; and nitrogen containing materials such as amines, alkanolamines, quaternary ammonium hydroxides and amides can be used in the present invention. The alkaline hydroxides, carbonates, bicarbonates, and silicates are preferably those of the alkali or alkaline earth metals or the ammonium salts.

Other materials that can be added are one or more of the following materials: water, alcohols, esters, ethers, cyclic ethers, ketones, alkanes, terpenes, dibasic esters, glycol ethers, pyrollidones, or low or non ozone depleting chlorinated and chlorinated/fluorinated hydrocarbons.

The use of these disclosed mixtures is in response to concerns about ozone depleting materials, and toxicity concerns with non ozone depleting chlorinated materials. In September 1987, the United States and 22 other countries signed the Montreal Protocol on Substances that Deplete the Ozone Layer (the "Protocol"). The Protocol called for a freeze in the production and consumption of ozone depleting chemicals ("ODP's" or "ODC's") by the year 2000 for developed countries and 2010 for developing countries. In 1990 the United States enacted the Clean Air act mandating that the use of ozone depleting chemicals be phased out by the year 2000. In September 1991, the U.S. Environmental Protection Agency announced that ozone layer depletion over North America was greater than expected. In response to this announcement, President George Bush issued an executive order accelerating the phase-out of the production of ozone depleting materials to Dec. 31, 1995. More that 90 nations, representing well over 90% of the world's consumption of ODP's, have agreed to accelerate the phase-out of production of high ozone depleting materials to Dec. 31, 1995 for developed countries and Dec. 31, 2005 for developing countries pursuant to the protocol.

Historically fluorine and chlorine based solvents were widely used for degreasing, solvating, solvent cleaning, aerosol cleaning, stripping, drying, cold cleaning, and vapor degreasing applications. In the most basic form the cleaning process required contacting a part with the solvent to remove an undesired material, soil or contaminant. In solvating applications these materials were added to dissolve materials in such applications as adhesive or paint formulations.

Cold cleaning, aerosol cleaning, stripping and basic degreasing were simple applications where a number of solvents were used. In most of these processes the soiled part was immersed in the fluid, sprayed with the fluid, or wiped with cloths or similar objects that had been soaked with the fluid. The soil was removed and the part was allowed to air dry.

Drying, vapor degreasing and/or solvent cleaning consisted of exposing a room temperature part to the vapors of a boiling fluid. Vapors condensing on the part provided a clean distilled fluid to wash away soils and contaminants. Evaporation of the fluid from the part provided a clean part similar to cleaning the part in uncontaminated fluid.

More difficult cleaning of difficult soils or stripping of siccative coatings such as photomasks and coatings required enhancing the cleaning process through the use of elevated fluid temperatures along with mechanical energy provided by pressures sprays, ultrasonic energy and or mechanical agitation of the fluid. In addition these process enhancements were also used to accelerate the cleaning process for less difficult soils, but were required for rapid cleaning of large volumes of parts. In these applications the use of immersion into 1 or more boiling sumps, combined with the use of the above mentioned process enhancements was used to remove the bulk of the contaminant. This was followed by immersion of the part into a sump that contained freshly distilled fluid, then followed by exposing the part to fluid vapors which condensed on the part providing a final cleaning and rinsing. The part was removed and the fluid evaporated off the clean part. Vapor degreasers suitable in the above-described process are well known in art.

In recent years the art was continually seeking new fluorocarbon based mixtures which offered similar cleaning characteristics to the chlorinated and CFC based mixtures and azeotropes. In the early 1990's materials based on the compounds of HCFC began to appear. Three molecules in particular 1,1-dichloro-1-fluoro ethane (HCFC-141b), dichloro trifluoro ethane (HCFC-123), and dichloro pentafluoro propane (HCFC-225) were proposed as replacements for methyl chloroform and CFC blends. As more highly fluorinated materials these materials were less ozone depleting than current ODP's however these materials were weaker solvents and in order to properly clean required the use of co-solvents through the use of blends and azeotropes.

The art in the mid 1990's progressed as aqueous and semi-aqueous materials became the major choice of replacement for ODP's. Many of the materials developed and selected were materials that usually had lower toxicity, volatility and higher flash points than common solvents. The art generally developed along three basic type of cleaning materials. These materials were water insoluble organics, water soluble inorganics and water soluble organics.

The development of water insoluble cleaning agents as ODP replacements took many new art forms, disclosed in many countries. Typically this art included the predominant use of aliphatic and aromatic hydrocarbons, terpene hydrocarbons, and water insoluble esters. These products usually were good agents to clean and solvate organic contaminants, however they had drawbacks in that they were difficult to rinse with water and had little effect on ionic or inorganic residues. In addition, being water insoluble they were limited in their application and could not be diluted with water for spray applications.

The art of water soluble inorganic materials has been well known for years, usually in low technology applications where gross contaminant removal was desired. The art was upgraded in the last 10 years as work was done to create new mixtures that had solvating and cleaning efficacy in high technology applications where ODP materials were used. The bulk of the inorganic materials used were alkali metal salts (usually sodium or potassium) which included hydroxides, carbonates, silicates, phosphates, and bicarbonates. Many of the inorganic mixtures also included the use of surfactants and water soluble organic solvents to assist in the cleaning application. Cleaning agents of this art usually were inexpensive and found application in many non critical cleaning applications. The drawback of this art is that the mixture usually had solubility for a narrow range of contaminants, and in most cases was ineffective against tough contaminants. Other issues concerned the high pH required of the mixture to effectively clean, concern of possible alkaline residues left on the substrate due to inadequate rinsing, and short bath life due to consumption of the agent by the contaminant.

The art of water soluble organic materials as ODP replacements was the third and most flexible route chosen as replacement materials. Typically the art included materials such as alcohols, ethers, esters, glycol ethers and pyrollidones. Most of the formulations that have been disclosed utilized these materials either alone or in combination with other solvents, alkalinity agents and or water. Most of the alcohols, esters and ethers selected that were water soluble typically had low molecular weights that created flash point or volatility issues in the mixture. Glycol ethers were another choice, however toxicity concerns became an issue with ethylene based glycol ethers. The art in the 1990's tended to move to propylene based glycol ethers because of their lesser toxicity concern. These materials however were not as robust as cleaners as alcohols or ethylene based glycol ethers, and required selective formulation and/or higher concentrations of the materials. Pyrollidones were also used in the art, however their broad use was limited because of cost, toxicity concerns and the highly aggressive nature of the material to some substrate materials.

A major drawback of the water soluble materials was the constant balance that was required to make the formulation clean a broad range of contaminants. Typically materials and mixtures could be found that were effective on ionic or polar soils, but were not effective on non-polar soils or oils. In addition some water soluble materials were very aggressive to some substrate materials such as coatings and metals. Hence proper selection of water soluble base materials is a key parameter in obtaining effective cleaning mixtures that clean efficiently and exhibit superior results over a broad range of contaminants.

The present invention overcomes the problems and disadvantages that currently exist by providing a cleaning mixture and process for cleaning efficiently a broad range of soils, which exhibits superior properties or results over the previous materials, mixtures and methods. It is, therefore, an object of the invention to provide an efficient, cost-effective process for cleaning, degreasing, stripping, solvating and/or removing residues and contaminants such as oils, grease, dirt, flux, inks, coatings, photoresists, resins and polymers from manufactured articles.

The present invention achieves that object by providing solvents and solvent mixtures and methods for cleaning, degreasing, stripping, solvating and/or removing residues and contaminants such as oils, grease, dirt, flux, inks, coatings, photoresists, resins and polymers from manufactured articles and hard surfaces such as, but not limited to metals, plastics, textiles, electronic devices, silicon wafers, mechanical devices or manufacturing equipment, which may be suitable for use on an industrial scale.

According to this invention, novel cleaning compositions are provided which contain a mixture of materials that have been found to be synergistic in cleaning a broad range of soils and contaminants. The mixture contains one or more compounds from the family described as a four-carbon cyclic ether, known in the art as a tetrahydrofuran ring. Four carbon cyclic ether solvents of the invention correspond to the following formula:

(Formula I)

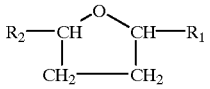

Where $R_1$ and $R_2$ can be independently hydrogen, or 1 to 8 carbon length alkyl, alkoxy or ether groups. Preferred compounds of formula I are water soluble and exhibit flash points greater than 100° F. (ca. 38° C.).

The second required compound of the mixture contains one or more compounds from the family described as a 3-alkoxy-3-methyl butanol and corresponds to the following formula: $R_3$ (Formula II)

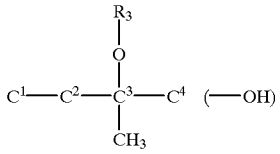

Where the OH group of the butanol can be attached to carbon position 1, 2 or 4, and $R_3$ is hydrogen or 1 to 8 carbon length alkyl. Preferred compounds of formula II are water soluble and exhibit flash points greater than 100° F.

Other optional compounds are materials that can be added to a mixture of the compounds of Formula I and Formula II that will maintain the pH of the mixture at greater than 6. The optional alkaline material is any material known to those skilled in the art that would cause the pH of the solution to be greater than 6. Materials such as alkaline hydroxides, carbonates, bicarbonates, and silicates, preferably those of the alkali or alkaline earth metals or ammonium; and nitrogen containing materials such as amines, alkanolamines, quaternary ammonium hydroxides and amides can be used in the present invention. The preferred compounds of the cleaning compositions are nitrogen containing compounds that also contain one hydroxyl group.

Other optional materials that can be added are one or more of the following materials: water, alcohols, esters, ethers, cyclic ethers, ketones, alkanes, terpenes, dibasic esters, glycol ethers, pyrollidones, or low or non ozone depleting chlorinated and chlorinated/fluorinated hydrocarbons. Preferred compounds that can be added are water soluble and exhibit flash points greater than 100° F.

The compositions may also be enhanced by one skilled in the art by adding buffering agents, surfactants, chelating agents, colorants, dyes, fragrances, indicators, inhibitors, and other conventional ingredients.

More specifically, the cleaning composition of the invention generally has a pH greater than 6.0, and contains effective amounts of the compounds of Formula I and Formula II.

Preferred compositions and methods for cleaning mixtures in accordance with this invention contain an effective amount of at least one compound of Formula I. In preferred embodiments, $R_1$ and $R_2$ are hydrogen or alkoxy groups containing from 1 to about 8 carbon atoms and, in a more preferred embodiment, the alkoxy groups contain from 1 to 3 carbon atoms. Specific examples of alkoxy groups containing from 1 to about 8 carbon atoms include methoxy, ethoxy, propoxy, butoxy, pentoxy, hexoxy, heptoxy, octoxy.

Examples of specific preferred 4-carbon cyclic ethers containing alkoxy groups, which can be used in the method of the invention, include tetrahydrofuran, tetrahydrofurfuryl alcohol, bis-hydroxymethyl tetrahydrofuran, tetrahydro-2-furanethanol, bis-hydroxyethyl tetrahydrofuran, tetrahydro-2-furanethanol, bis-hydroxypropyl tetrahydrofuran. Most preferred are tetrahydrofurfuryl methanol and bis-hydroxymethyl tetrahydrofuran.

In another preferred embodiment, $R_1$ and $R_2$, in Formula I are each, independently, hydrogen, alkoxy and/or ether groups containing from 1 to about 8 carbon atoms and, in a more preferred embodiment, the alkoxy and/or ether groups contain from 1 to 4 carbon atoms. Specific examples of alkoxy groups containing from one to 8 carbon atoms include methoxy, ethoxy, propoxy, butoxy, pentoxy, hexoxy, heptoxy, and octoxy. Specific examples of ethers are methoxy methyl ether, methoxy ethyl ether, methoxy propyl ether, methoxy butyl ether, ethoxy methyl ether, ethoxy ethyl ether, and ethoxy propyl ether. Most preferred are: tetrahydrofuran-2-methoxy ether, tetrahydrofuran-2,5-dimethoxy ether, tetrahydrofuran-2-methoxy ethyl ether, tetrahydrofuran-2-ethoxy ether, tetrahydrofuran-2,5-diethoxy ether and tetrahydrofuran-2-methoxy propyl ether.

Preferred compositions and methods for cleaning mixtures in accordance with this invention contain an effective amount of at least one compound of Formula II. In preferred embodiments, the OH group of the butanol can be attached to carbon position 1, 2 or 4, and $R_3$ is 1 to 8 carbon length alkyl. In preferred embodiments, $R_3$ is hydrogen or alkoxy groups containing from 1 to about 8 carbon atoms and, in a more preferred embodiment, the alkyoxy groups contain from 1 to 3 carbon atoms. Specific examples of alkoxy groups containing from 1 to about 8 carbon atoms include methoxy, ethoxy, propoxy, butoxy, pentoxy, hexoxy, heptoxy, octoxy.

Examples of specific preferred materials are 3-methyl-3-hydroxy-1-butanol, 3-methyl-3-methoxy-1-butanol, 3-methyl-3-ethoxy-1-butanol, 3-methyl-3-propoxy-1-butanol, 3-methyl-3-methoxy-2-butanol, and 3-methyl-3-methoxy-4-butanol. Most preferred is 3-methyl-3-methoxy-1-butanol.

In this embodiment, the solution may comprise from about 0.01 up to about 99.9% by weight of either compound of Formula I or Formula II.

Preferred compositions and methods for cleaning mixtures in accordance with this invention optionally contain effective amounts of materials that can be added to a mixture of the two above disclosed materials that will maintain the pH of the mixture at greater than 6. The optional alkaline material is any material known to those skilled in the art that would cause the pH of the solution to be greater than 6. Materials such as alkaline hydroxides, carbonates, bicarbonates, and silicates; and nitrogen containing materials such as amines, alkanolamines, quaternary ammonium hydroxides and amides can be used in the present invention. The preferred compounds of the cleaning compositions are nitrogen containing compounds that also contain one hydroxyl group. Most preferred are monoethanolamine, diethanolamine, triethanolamine, 1-amino-2-propanol, ethylenediamine, hexamethyldiamine, 1,3-pentanediamine, n-isopropyl hydroxylamine, and 2-methyl-pentamethylenediamine.

The materials of Formulas I and II useful as cleaning mixtures in accordance with this invention are soluble in various solvents, such as water, alcohols, aqueous inorganic hydroxides, esters, ethers, cyclic ethers, ketones, alkanes, terpenes, dibasic esters, glycol ethers, pyrrolidones, or low or non-ozone depleting chlorinated and chlorinated/fluorinated hydrocarbons. Thus, the composition or mixture utilized in the process of the invention, and which comprises one or more of the above-described compounds, may be dissolved in any one or more of the before-mentioned solvents as an additional component of the cleaning composition. The detailed description below provides a non-limiting disclosure of the additional components that may be selected. The compositions of the invention, thus, may also include one or more of the above-mentioned solvents. Aqueous and non aqueous solutions of tetrahydrofurfuryl alcohol, 3-methyl 3-methoxy-1-butanol and amines, alkaline agents containing 1 or more hydroxyl groups are preferred in the practice of the invention, but other solvents may be used in conjunction with those. The form the compositions are in when used for cleaning may vary from liquid at various temperatures, to vapor, to aerosol, or other dispersions appropriate for the components of the composition selected. Buffers, corrosion inhibitors and other additives may also be included in the cleaning compositions of the invention.

The material to be removed from a surface or cleaned by this invention can be any residue and contaminants such as oils, grease, dirt, flux, inks, coatings, photoresists, resins and polymers.

Specific examples of parts or articles cleaned by the process or compositions of this invention include manufactured articles and hard surfaces such as, but not limited to metals, plastics, textiles, electronic devices, silicon wafers, mechanical devices or manufacturing equipment.

Contacting an article with a cleaning composition according to the invention may be through a conventional process or means known in the art that includes but is not limited to: wiping; spraying; immersing; high pressure spray agitation; ultrasonic agitation; vapor degreasing; and soaking. The equipment to perform these processes is known in the art or can be devised from other fields where applying a composition to a solid surface is involved. The process may be conducted at ambient temperature or up to the boiling point of the selected cleaning composition. Generally, temperature ranges from about 32° F. (0° C.) to about 230° F. (110° C.) are used. The temperature used may also be determined by the selection of the manner of contacting the cleaning composition to the surface to be cleaned. The process is most commonly conducted at atmospheric pressure, but may be conducted at elevated pressure, in a vacuum, or at lower than atmospheric pressure conditions.

The part or article is contacted with the desired cleaning composition for a sufficient period of time to essentially remove the contaminant or remove the desired amount of the contaminant. The part or article can also be called a "surface" that is to be cleaned. Depending on the nature of the article and the use to which it will be put, it may not be necessary for every detectable trace of a contaminant to be removed from the surface. The contaminant may be any unwanted or undesired materials in contact with the substrate surface and may include is not limited to oils, grease, dirt, flux, inks, coatings, photoresists, resins and polymers, present in an amount ranging from a residue to a clearly visible amount.

It may, in most instances, be necessary or desirable to rinse the cleaning composition from the part or article with water or with one of the solvents listed above, or with any combination of water and solvents. One skilled in the art can devise numerous combinations of cleaning compositions and rinsing solutions from this disclosure and the known properties of the chemicals used. In addition, one skilled in the art can devise simple tests to determine the appropriate rinsing conditions for a cleaning composition selected. It is common in the art to select a rinsing solution that will effectively remove all of the cleaning agent or composition and allow the rinsing solution to dry from the part either through the use of moving air, heated air and/or natural evaporation. Compounds that affect the odor of a surface being cleaned, that inhibit the corrosion of the surface, or that act as a surfactant can also be added to the cleaning compositions or rinsing solutions and used in the cleaning methods.

DETAILED DESCRIPTION OF THE PREFERRED EMBODIMENTS

In accordance with the invention, novel compositions have been used to clean, degrease, strip, solvate and/or remove residues and contaminants such as oils, grease, dirt, flux, inks, coatings, photoresists, resins and polymers from manufactured articles and hard surfaces such as, but not limited to metals, plastics, textiles, electronic devices, silicon wafers, mechanical devices or manufacturing equipment. The compositions of the invention comprise at least one 4-carbon cyclic ether compound and at least one 3-alkoxy-3-methyl butanol compound, and have a pH of 6.0 or greater by optionally adding alkaline materials. The preferred materials of the disclosure are tetrahydrofuran compounds that also contain one hydroxyl group such as tetrahydrofurfuryl alcohol, and 3-methoxy 3-methyl-1-butanol, and nitrogen containing alkaline compounds with at least one hydroxyl group that cause the pH to be greater than 6 for the composition. The summary above discloses Formulae I and II and the general structure of the alkaline containing compound of the compositions and methods of the invention.

Other materials that can be added to the composition and/or used in the method of the invention are one or more of the following materials: water; alcohols; esters; ethers; cyclic ethers; ketones; alkanes; terpenes; dibasic esters; glycol ethers; pyrrolidones; or low or non-ozone depleting chlorinated and chlorinated/fluorinated hydrocarbons. The resulting mixture may also be enhanced by one skilled at the art by the addition of buffering agents, surfactants, chelating agents, colorants, dyes, fragrances, indicators, inhibitors, and other conventional ingredients.

Preferably, an effective amount of water is added to the solution to increase cleaning efficiency, decrease flash point, modify viscosity, or modify the solution's aggressiveness to substrates. Most preferred is the use of de-ionized water.

Preferably, the alcohol component of the mixture contains an effective amount of the alcohol material of the formula $C_xH_y(OH)_z$ where x=1 to 18, y<2x+2 and z=1 or 2. Examples of these alcohols are methanol, ethanol, propanol, isopropanol, butanol, 2-butanol, tert butyl alcohol, 1-pentanol, 2-pentanol, 3-pentanol, methyl propanol, methyl butanol, trifluoroethanol, allyl alcohol, 1-hexanol, 2-hexanol, 3-hexanol, 2-ethyl hexanol, 1-pentanol, 1-octanol, 1-decanol, 1-dodecanol, cyclohexanol, cyclopentanol, benzyl alcohol, ethylene glycol, propylene glycol, and butylene glycol. They can usable either singly or in the form of a mixture of two or more of them. In the composition x can be a number 1 to 12, preferably 1 to 8, more preferably 1 to 6. Among the most preferred are methanol, ethanol, isopropanol, and benzyl alcohol.

Preferably, the ester component of the mixture contains an effective amount of the ester material of the formula $R_1$—COO—$R_2$ where $R_1$ is $C_1$–$C_{20}$ alkyl, $C_5$–$C_6$ cycloalkyl, benzyl, furanyl or tetrahydrofuranyl, $R_2$ is hydrogen, $C_1$–$C_8$ alkyl, $C_5$–$C_6$ cycloalkyl, benzyl, phenyl, furanyl or tetrahydrofuranyl. Examples of these esters are methyl formate, methyl acetate, methyl propionate, methyl butyrate, ethyl formate, ethyl acetate, ethyl propionate, ethyl butyrate, propyl formate, propyl acetate, propyl propionate, propyl butyrate, butyl formate, butyl acetate, butyl propionate, butyl butyrate, methyl soyate, isopropyl myristate, propyl myristate, and butyl myristate. In the composition listed $R_1$, $R_2$ can be a $C_1$ to $C_{20}$ alkyl, preferably $C_1$ to $C_8$, more preferably $C_2$ to $C_6$ or hydrogen. Among the most preferred are methyl acetate, ethyl acetate and amyl acetate.

Preferably, the ether component of the mixture contains an effective amount of the ether material of the formula $R_3$—O—$R_4$ where $R_3$ is $C_1$–$C_{10}$ alkyl or alkynl, $C_5$–$C_6$ cycloalkyl, benzyl, phenyl, furanyl or tetrahydrofuranyl, $R_4$ is $C_1$–$C_{10}$ alkyl or alkynl, $C_5$–$C_6$ cycloalkyl, benzyl, phenyl, furanyl or tetrahydrofuranyl. Examples of these ethers are ethyl ether, methyl ether, propyl ether, isopropyl ether, butyl ether, methyl tert butyl ether, ethyl tert butyl ether, vinyl ether, allyl ether and anisole. In the composition $R_3$, $R_4$ can be a $C_1$ to $C_{10}$ alkyl or alkynl, preferably $C_1$ to $C_6$ alkyl or alkynl, more preferably $C_1$ to $C_4$ alkyl. Among the most preferred are isopropyl ether and propyl ether.

Preferably, the cyclic ether component of the mixture contains an effective amount of the cyclic ether. The preferred materials for cyclic ethers are: 1,4-dioxane, 1,3-dioxolane, tetrahydropyran (THP), methyl THP, dimethyl THP, ethylene oxide, propylene oxide, butylene oxide, amyl oxide, and isoamyl oxide. Among the most preferred is 1,3-dioxolane and tetrahydropyran.

Preferably, the ketone component of the mixture contains an effective amount of the ketone material of the formula: $R_5—C=O—R_6$ where $R_5$ is $C_1$–$C_{10}$ alkyl, $C_5$–$C_6$ cycloalkyl, benzyl, furanyl or tetrahydrofuranyl, $R_6$ is $C_1$–$C_{10}$ alkyl, $C_1$–$C_6$ cycloalkyl, benzyl, phenyl, furanyl or tetrahydrofuranyl. Examples of these ketones are acetone, methyl ethyl ketone, 2-pentanone, 3-pentanone, 2-hexanone, 3-hexanone, and methyl isobutyl ketone. In the composition $R_5$, $R_6$ can be a number $C_1$ to $C_{10}$ alkyl, preferably $C_1$ to $C_6$ alkyl or alkynl, more preferably $C_1$ to $C_4$ alkyl. Among the most preferred are acetone, methyl ethyl ketone, 3-pentanone and methyl isobutyl ketone.

Preferably, the alkane component of the mixture contains an effective amount of the alkane material of the formula: $C_nH_{n+2}$ where n=1–20, or $C_4$–$C_{20}$ cycloalkanes. Examples of these alkanes are methane, ethane, propane, butane, methyl propane, pentane, isopentane, methyl butane, cyclopentane, hexane, cyclohexane, dimethylcyclohexane, ethylcyclohexane, isohexane, heptane, methyl pentane, dimethyl butane, octane, nonane and decane. In the composition listed x can be a number 1 to 20, preferably 4 to 9, more preferably 5 to 7. Among the most preferred are cyclopentane, cyclohexane, dimethylcyclohexane, ethylcyclohexane, hexane, methyl pentane, and dimethyl butane.

Preferably, the terpene component of the mixture disclosed above contain effective amounts of the terpene material containing at least 1 isoprene group of the general structure:

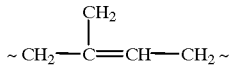

The molecule may be cyclic or multicyclic. Preferred examples are d-limonene, pinene, terpinol, turpentine and dipentene.

Preferably, the dibasic ester component of the mixture contains an effective amount of the dibasic ester material of the formula: $R_7—COO—R_8—COO—R_9$ where $R_7$ is $C_1$–$C_{20}$ alkyl, $C_5$–$C_6$ cycloalkyl, benzyl, furanyl or tetrahydrofuranyl, $R_8$ is $C_1$–$C_{20}$ alkyl, $C_5$–$C_6$ cycloalkyl, benzyl, phenyl, furanyl or tetrahydrofuranyl, $R_9$ is $C_1$–$C_{20}$ alkyl, $C_5$–$C_6$ cycloalkyl, benzyl, furanyl or tetrahydrofuranyl. Examples of these dibasic esters are dimethyl oxalate, dimethyl malonate, dimethyl succinate, dimethyl glutarate, dimethyl adipate, methyl ethyl succinate, methyl ethyl adipate, diethyl succinate, diethyl adipate. $R_7$, $R_8$ and $R_9$ can be a $C_1$ to $C_{10}$ alkyl, preferably $C_1$ to $C_6$ alkyl or alkynl, more preferably $C_1$ to $C_4$ alkyl. Among the most preferred are dimethyl succinate, and dimethyl adipate.

Preferably, the glycol ether component of the mixture contains an effective amount of the glycol ether material of the formula: $R_{11}—O—R_{12}$, where $R_{11}$ may be substituted by $R_{10}—O—$, where $R_{10}$ can be $C_2$–$C_{20}$ alkyl, $C_5$–$C_6$ cycloalkyl, $C_1$–$C_6$ glycol ether acetate, benzyl, furanyl or tetrahydrofuranyl, $R_{11}$ is $C_1$–$C_{20}$ alkyl, $C_5$–$C_6$ cycloalkyl, benzyl, phenyl, furanyl or tetrahydrofuranyl, $R_{12}$ is hydrogen or an alcohol selected from claim 7 above. Examples of these glycol ethers are ethylene glycol methyl ether, diethylene glycol methyl ether, ethylene glycol ethyl ether, diethylene glycol ethyl ether, ethylene glycol propyl ether, diethylene glycol propyl ether, ethylene glycol butyl ether, diethylene glycol butyl ether, propylene glycol methyl ether, propylene glycol acetate, dipropylene glycol, dipropylene glycol methyl ether, dipropylene glycol methyl ether acetate, propylene glycol propyl ether, dipropylene glycol propyl ether, propylene glycol butyl ether, and dipropylene glycol butyl ether. $R_{10}$, $R_{11}$ and $R_{12}$ can be a $C_1$ to $C_{10}$ alkyl, preferably $C_1$ to $C_6$ alkyl, more preferably $C_1$ to $C_4$ alkyl. Among the most preferred are propylene glycol butyl ether, dipropylene glycol methyl ether, dipropylene glycol methyl ether acetate, dipropylene glycol, and diethylene glycol butyl ether.

Preferably, the pyrrolidone component of the mixture contains an effective amount of the pyrrolidone material that is substituted in the N position of the pyrrolidone ring of the formula by hydrogen, $C_1$ to $C_6$ alkyl, or $C_1$ to $C_6$ alkanol. Examples of these pyrrolidones are pyrrolidone, N-methyl pyrrolidone, N-ethyl pyrrolidone, N-propyl pyrrolidone, N-hydroxymethyl pyrrolidone, N-hydroxyethyl pyrrolidone, and N-hexyl pyrrolidone. Among the most preferred are N-methyl pyrrolidone and N-ethyl pyrrolidone.

Preferably, the chlorinated hydrocarbon component of the mixture contains an effective amount of the chlorinated hydrocarbon material of the formula: $R_{13}—Cl_X$ where $R_{13}$ is $C_1$–$C_{20}$ alkyl, $C_4$–$C_{10}$ cycloalkyl, $C_2$–$C_{20}$ alkenyl benzyl, phenyl, and X>1, and the Ozone Depletion Potential (ODP) of the molecule <0.15. Examples of these chlorinated materials are methyl chloride, methylene chloride, ethyl chloride, dichloro ethane, dichloro ethylene, propyl chloride, isopropyl chloride, propyl dichloride, butyl chloride, isobutyl chloride, sec-butyl chloride, tert-butyl chloride, pentyl chloride, and hexyl chloride.

The content of the additional components in the mixture of the present invention is not particularly critical, but for the addition of an effective amount necessary to improve or control solubility, volatility, boiling point, flammability, surface tension, viscosity, reactivity, and material compatibility. The mixture may also be enhanced by one skilled at the art by the addition of buffering agents, surfactants, chelating agents, colorants, dyes, fragrances, indicators, inhibitors, and other ingredients, all of which are well-known to those skilled in the art.

Any compound or mixture of compounds suitable for reducing the pH of the cleaner solutions of this invention, and which do not unduly adversely inhibit the cleaning action thereof or interfere with the resulting cleaned parts, may be employed. As examples of such compounds are, for example, acids, bases and their salts acting as buffers, such as inorganic mineral acids and their salts, weak organic acids having a pKa of greater than 2 and their salts, ammonium salts, and buffer systems such as weak acids and their conjugate bases, for example, acetic acid and ammonium acetate. Preferred for use as such components are acetic acid, boric acid, citric acid potassium biphthalate, mixtures of ammonium chloride and ammonium acetate, especially a 1:1 mixture of these two salts, and mixtures of acetic acid and ammonia and other amines.

The following examples are illustrative of the present invention and are not meant to, and should not be taken to, limit the scope of the invention.

EXAMPLE 1

An electronic hybrid microcircuit was selected that has been contaminated with an RA type flux, along with common residual oils, greases and salts common to the electronic assembly manufacturing process. The contaminated part was immersed in a solution of 97% tetrahydrofurfuryl alcohol, 1% 3 methoxy-3-methyl-1-butanol, 0.9% monoethanolamine, and 1.1 surfactants and inhibitors at 150 to 160° F. (ca. 650 to ca. 71° C.) for 10 minutes. The part was removed from the solution, rinsed with water and allowed to air dry. Upon visual inspection the contaminants were observed to be removed. Upon further inspection it appears the formulation removed a polyurethane coating from a wire on the part, which was not a desired material to remove from the part.

EXAMPLE 2

An electronic hybrid microcircuit the same as that used in Example 1 was selected that has been contaminated with an RA type flux, along with common residual oils, greases and salts common to the electronic assembly manufacturing process. The contaminated part was immersed in a solution of 1% tetrahydrofurfuryl alcohol, 97% 3 methoxy-3-methyl-1-butanol, 0.9% monoethanolamine, and 1.1% surfactants and inhibitors at 150 to 160° F. (ca 65° to ca. 71° C.) for 10 minutes. The part was removed from the solution, rinsed with water and allowed to air dry. Upon visual inspection the contaminants were observed to be removed. In addition the urethane coating seemed to be intact with no visual signs of removal or damage.

EXAMPLE 3

An ethyl cellulose type of coating contaminated with a number of contaminants typical to the manufacture of capacitors and resistors was hardened on the external side of a steel test coupon and the coupon was further contaminated with fingerprint oils and dirt. The contaminated part was immersed in a solution of 35% tetrahydrofurfuryl alcohol, 35% 3 methoxy-3-methyl-1-butanol, and 30% dipropylene glycol monomethyl ether acetate at 120° F. (ca. 50° C.) for 3 minutes. The part was removed from the solution, rinsed with water and allowed to air dry. Upon visual inspection the contaminants were observed to be removed.

EXAMPLE 4

A conductive ink contaminated with a number of contaminants typical to the manufacture of capacitors and resistors was hardened on the external side of a steel test coupon and the coupon was further contaminated with fingerprint oils and dirt. The contaminated part was immersed in a solution of 35% tetrahydrofurfuryl alcohol, 35% 3 methoxy-3-methyl-1-butanol, and 30% dipropylene glycol monomethyl ether acetate at 130° F. (ca. 55° C.) for 1 minute. The part was removed from the solution, rinsed with water and allowed to air dry. Upon visual inspection the contaminants were observed to be removed.

EXAMPLE 5

A ceramic slip material used to make capacitors and resistors, contaminated with a number of contaminants typical to the manufacture of capacitors and resistors, was hardened on the external side of a steel test coupon and the coupon was further contaminated with fingerprint oils and dirt. The contaminated part was immersed in a solution of 35% tetrahydrofurfuryl alcohol, 35% 3-methoxy-3-methyl-1-butanol, and 30% dipropylene glycol monomethyl ether acetate at 135° F. (ca. 60° C.) for 8 minutes. The part was removed from the solution, rinsed with water and allowed to air dry. Upon visual inspection the contaminants were observed to be removed.

EXAMPLE 6

An electronic circuit board was selected that has been contaminated with three types of flux, RA, RMA and a low solids "No-Clean" flux, along with common residual oils, greases and salts common to the electronic assembly manufacturing process. The contaminated part was spray washed using an inline cleaning machine having a cleaning solution of 0.7% tetrahydrofurfuryl alcohol, 18% 3 methoxy-3-methyl-1-butanol, 1.9% monoethanolamine, and 1.1% surfactants and inhibitors and 79.4% water at 150 to 160° F. (ca 65° to ca. 71° C.) for 3 minutes in the wash section, 2 minutes in the water rinse section. The board was moved by conveyor through the wash and dry sections and was dried in a heated dryer section. Upon visual inspection the contaminants were observed to be completely removed, with the exception of some white residue remaining from resin like substances in the no-clean flux.

EXAMPLE 7

A photoresist polymer contaminated with a number of contaminants typical to the manufacture of semiconductors and rosin flux residue was selected. The photoresist was hardened on the external side of a silicon wafer via a baking process common to wafer manufacturing and the wafer was further contaminated with fingerprint oils and dirt. The contaminated part was immersed in a solution of 35% tetrahydrofurfuryl alcohol, 30% 3 methoxy-3-methyl-1-butanol, and 15% amino methyl propanol, 5% hexamethyldiamine and 15% water at 185° F. (ca. 85° C.) for 10 minutes. The part was removed from the solution, rinsed with water and allowed to air dry. Upon visual inspection the contaminants were observed to be removed.

EXAMPLES 8–16

A number of contaminants typical to many manufacturing processes were was selected. The selected contaminants were: motor oil, bearing grease, lipstick, adhesive, epoxy coating, latex paint, beeswax, RA flux, and low solids no clean flux. Steel test coupons were contaminated with the soils and allowed 24 hours to dry, bake or cure, the coupon was further contaminated with fingerprint oils and dirt in sample preparation process. The contaminated part was immersed in a solution of 1% tetrahydrofurfuryl alcohol, 80% 3 methoxy-3-methyl-1-butanol, and 19% water at 140° F. (ca. 60° C.) for 2 minutes. The two minute cleaning interval was selected to easily indicate cleaning differences with the cleaning solutions and soils, although it is believed the soil can be fully cleaned given a longer cleaning time and/or with the use of mechanical energy. The part was removed from the solution, rinsed with water and allowed to air dry. The coupon was visually inspected and was graded on a scale from 1 to 5 with 1 being poor cleaning, 5 being visually cleaned. The results are listed below:

| | |
|---|---|
| Motor Oil | 2 |
| Bearing Grease | 1 |
| Lipstick | 1 |
| Adhesive | 2 |
| Epoxy Coating | 1 |
| Latex Paint | 2 |
| Beeswax | 1 |
| RA Flux | 3 |
| Low solids flux | 1 |

EXAMPLES 17–25

Using the methods of Examples 8–16, coupons contaminated with contaminants typical to many manufacturing processes were immersed in a solution of 10% tetrahydrofurfuryl alcohol, and 90% 3 methoxy-3-methyl-1-butanol at 140° F. (ca. 60° C.) for 2 minutes. The part was removed from the solution, rinsed with water and allowed to air dry. The coupon was visually inspected and was graded on a scale from 1 to 5 with 1 being poor cleaning, 5 being visually cleaned. The results are listed below:

| | |
|---|---|
| Motor Oil | 3 |
| Bearing Grease | 1 |
| Lipstick | 4 |
| Adhesive | 2 |
| Epoxy Coating | 4 |
| Latex Paint | 2 |
| Beeswax | 5 |
| RA Flux | 4 |
| Low solids flux | 5 |

EXAMPLES 26–34

Using the methods of Examples 8–16, coupons contaminated with contaminants typical to many manufacturing processes were immersed in a solution of 1% tetrahydrofurfuryl alcohol, 94% 3 methoxy-3 methyl-1-butanol and 5% monoethanolamine at 140° F. (ca. 60° C.) for 2 minutes. The part was removed from the solution, rinsed with water and allowed to air dry. The coupon was visually inspected and was graded on a scale from 1 to 5 with 1 being poor cleaning, 5 being visually cleaned. The results are listed below:

| | |
|---|---|
| Motor Oil | 5 |
| Bearing Grease | 1 |
| Lipstick | 4 |
| Adhesive | 2 |
| Epoxy Coating | 4 |
| Latex Paint | 1 |
| Beeswax | 5 |
| RA Flux | 4 |
| Low solids flux | 5 |

EXAMPLES 35–43

Using the methods of Examples 8–16, coupons contaminated with contaminants typical to many manufacturing processes were immersed in a solution of 1% tetrahydrofurfuryl alcohol, 94% 3 methoxy-3-methyl-1-butanol and 5% dipropylene glycol methyl ether at 140° F. (ca. 60° C.) for 2 minutes. The part was removed from the solution, rinsed with water and allowed to air dry. The coupon was visually inspected and was graded on a scale from 1 to 5 with 1 being poor cleaning, 5 being visually cleaned. The results are listed below:

| | |
|---|---|
| Motor Oil | 4 |
| Bearing Grease | 1 |
| Lipstick | 4 |
| Adhesive | 2 |
| Epoxy Coating | 4 |
| Latex Paint | 1 |
| Beeswax | 5 |
| RA Flux | 5 |
| Low solids flux | 5 |

EXAMPLES 44–52

Using the methods of Examples 8–16, coupons contaminated with contaminants typical to many manufacturing processes were immersed in a solution of 1% tetrahydrofurfuryl alcohol, 94% 3 methoxy-3-methyl-1-butanol and 5% dipropylene glycol methyl ether acetate at 140° F. (ca. 60° C.) for 2 minutes. The part was removed from the solution, rinsed with water and allowed to air dry. The coupon was visually inspected and was graded on a scale from 1 to 5 with 1 being poor cleaning, 5 being visually cleaned. The results are listed below:

| | |
|---|---|
| Motor Oil | 4 |
| Bearing Grease | 1 |
| Lipstick | 3 |
| Adhesive | 1 |
| Epoxy Coating | 4 |
| Latex Paint | 2 |
| Beeswax | 5 |
| RA Flux | 4 |
| Low solids flux | 5 |

Although the invention has been described and illustrated in detail, it is to be clearly understood that the same is by way of illustration and example, and is not to be taken as a limitation. The spirit and scope of the present invention are to be limited only by the terms of the appended claims. One skilled in the art can make many adjustments, changes, or modifications to the components of the compositions used to clean contaminants from solid surfaces without departing from the spirit or scope of this invention. For example, more than one combination of the cleaning compositions can be used sequentially to clean an article or part, optionally employing different types of methods for the composition to contact the article or part, and optionally under differing conditions.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A composition for cleaning contaminants from a surface, consisting essentially of tetrahydrofurfuryl alcohol and 3-methoxy-3-methyl butanol.

2. The composition of claim 1, further including an effective amount of an alkaline material to cause the pH of the composition to be 6 or greater.

3. The composition of claim 2, wherein said alkaline material is selected from the group consisting of hydroxides, carbonates, bicarbonates, silicates, amines, alkanolamines, quaternary ammonium hydroxides, amides and mixtures thereof.

4. The composition of claim 3, wherein the alkaline material is a nitrogen containing compound selected from the group consisting of ammonia, hydroxylamine, methylamine, dimethylamine, trimethylamine, ethylamine, diethylamine, triethylamine, monoethanolamine, diethanolamine, triethanolamine, 1-amino-2-propanol, 1-amino-3-propanol, 2-(2-aminoethoxy)ethanol, 2-(2-aminoethylamino)ethanol, 2-(2-aminoethylamino) ethylamine, ethylenediamine, hexamethyldiamine, 1,3 pentanediamine, n-isopropylhydroxyamine, 2-methylpentamethylenediamine, and mixtures thereof.

5. The composition of claim 1, further comprising water.

6. The composition of claim 1, further comprising a surfactant.

7. The composition of claim 1, further comprising a perfume.

8. The composition of claim 1, further comprising a corrosion inhibitor.

9. A method for removing a contaminant from a solid surface comprising contacting said surface with a composition as defined in claim 1.

10. A method for removing a contaminant from a solid surface as defined in claim 9, comprising sequentially contacting said surface with one or more of said compositions.

11. A method according to claim 9, wherein the solid surface is contaminated with residues and contaminants selected from the group consisting of oils, grease, dirt, flux, inks, coatings, photoresists, resins, polymers, and mixtures thereof.

12. A method as claimed in claim 11, wherein the solid surface is at least one member selected from the group consisting of metals, plastics, textiles, electronic devices, silicon wafers, mechanical devices or manufacturing equipment.

13. A method as claimed in claim 9, wherein the composition is at a temperature up to and including the boiling point of the composition.

14. A method as claimed in claim 13, wherein the composition is at a temperature from about 32° F. to about 220° F.

15. The method of claim 9, comprising contacting the solid surface with the composition as an aerosol.

16. The method of claim 9, wherein the composition is in the form of a liquid.

17. The method of claim 9, comprising contacting the surface with the composition as a vapor.

18. The method of claim 9, further comprising bringing the composition in contact with the surface by agitation, pressure spray, and/or ultrasonic energy.

19. A method according to claim 9, further comprising rinsing the surface with water.

20. A method according to claim 9, wherein the surface is modified by a surfactant.

21. A method according to claim 9, wherein the odor of the surface is modified by a perfume.

22. The composition of claim 1, wherein the 3-methoxy-3-methyl butanol is selected from the group consisting of 3-methyl-3-methoxy-1-butanol, 3-methyl-3-methoxy-2-butanol, and 3-methyl-3-methoxy-4-butanol.

* * * * *